United States Patent [19]

St. Ours

[11] Patent Number: 5,072,455

[45] Date of Patent: Dec. 17, 1991

[54] HEAT-INTERCEPTING GARMENT OR BLANKET

[76] Inventor: Thomas A. St. Ours, 1548 County Rd. 240, Apt. 9, Durango, Colo. 81301

[21] Appl. No.: 644,749

[22] Filed: Jan. 23, 1991

Related U.S. Application Data

[63] Continuation of Ser. No. 317,015, Feb. 27, 1989, abandoned, which is a continuation-in-part of Ser. No. 80,674, Jul. 31, 1987, abandoned.

[51] Int. Cl.[5] ..... A41D 1/04; A41D 27/12

[52] U.S. Cl. ..... 2/81; 2/102; 2/92

[58] Field of Search ..... 2/2, 44, 92, 102, 243 A, 2/2.5, 81

[56] References Cited

U.S. PATENT DOCUMENTS

| | | | |
|---|---|---|---|
| 2,338,535 | 1/1944 | Pfleumer . | |
| 2,484,698 | 11/1949 | Emms . | |
| 2,561,891 | 7/1951 | Tucker . | |
| 3,997,982 | 12/1976 | Holland . | |
| 4,147.829 | 4/1979 | Holland . | |
| 4,328,533 | 5/1982 | Paredes . | |
| 4,399,668 | 8/1983 | Williamson | 62/457 |
| 4,401,707 | 8/1983 | Bailey et al. . | |
| 4,637,076 | 1/1987 | Tartt et al. . | |
| 4,637,947 | 1/1987 | Mackawa . | |
| 4,697,285 | 10/1987 | Sylvester . | |

FOREIGN PATENT DOCUMENTS

| | | | |
|---|---|---|---|
| 882684 | 1/1954 | Fed. Rep. of Germany | 2/81 |
| 3521813 | 1/1987 | Fed. Rep. of Germany | 2/2 |

OTHER PUBLICATIONS

Occupational Hazards, Sep. 1986, p. 82, advertisement for "The Banier Vest".

*Primary Examiner*—Stuart S. Levy
*Assistant Examiner*—Joseph A. Rhoa
*Attorney, Agent, or Firm*—Kenton L. Freudenberg; Maxwell C. Freudenberg

[57] ABSTRACT

A heat-intercepting shield or shroud in the form of a garment, blanket or belt having on at least one surface thereof one or more pockets to receive replaceable packets of refreezable material which absorb large quantities of heat as the material melts. Each pocket has two coextensive fabric layers stitched together to form opposite pocket walls. Over the entire pocket area and next to the one wall are coextensive layers of non-breathable continuous reflective material and of insulating material. These materials are flexible and are stitched next to that one pocket wall in seams at the edge of the pocket so that both heat reflection and retardation of heat flow by the insulation occurs over the entire pocket area. Between the layer of insulation and the other pocket wall is a space for a heat absorbing packet or packets of frozen gel. The side of the shield or shroud with the packet or packets is placed toward the object to be cooled or protected from external radiant, conductive or convective heat.

16 Claims, 4 Drawing Sheets

HEAT-INTERCEPTING GARMENT OR BLANKET

This application is a continuation of Ser. No. 07/317015, filed 2-27-89, which is a continuation in part of application Ser. No. 07/080,674, filed July 31, 1987, abandoned upon the filing of this application.

BACKGROUND OF THE INVENTION

The present invention relates generally to devices for controlling the rate of heat transfer between portions of the human body and the environment around the body. In some cases the invention is used primarily to reduce the amount of heat reaching the body from an unusually hot environment. In other cases the invention is used primarily to reduce the body temperature in a less hostile environment by absorbing heat from the body.

There are many industrial situations where individuals are required to work in hostile environments where the temperature is so high that it cannot reasonably be tolerated for a satisfactory period of time. This is particularly true where high temperature processes are being performed where the worker cannot be readily isolated from the processing itself or fr hot equipment or a surrounding hot environment. In such cases there is a need to keep radiant, conductive and/or convective heat from reaching the workers body, particularly the human trunk. Where the environmental temperature or heat level is extremely high, as near an open furnace or the like, the primary concern is to intercept a large amount of the heat which would otherwise reach the worker. This may be done by reflection and adsorption. Preferably the heat not reflected is dissipated as heat of fusion in melting a frozen material. Insulation may also be used between the heat source and the body to help control the amount of heat reaching the body.

It is essential that any equipment or garments used by a worker to protect his body by intercepting heat present a minimum burden during working conditions. If refreezable packs of heat absorptive material are used they must be easy to place in the equipment or garments and preferably be of uniform size to facilitate handling and replacement. A garment should be made so that inner faces of the refreezable packets of heat-absorptive material are held in good heat transfer relationship with the worker's body. If the equipment or garment is worn or carried it must be light weight, comfortable, efficient, and easily and practically maintained. This includes keeping it clean and sanitary. Usually industrial laundering is required with attendant harsh agitation is hot laundering liquids.

The prior art includes vest-like garments worn by workers to intercept heat while working in hostile environments. One such garment had generally straight-sided front and rear panel portions each of which had three horizontal different sized pockets containing removable packets of refreezable gel material. The packets were divided horizontally into three sections each containing an envelope of gel. When the gel was frozen solid the packets could bend where the sections were divided to give some flexibility to the packet. However this prior art garment had several deficiencies which have been overcome by the present invention. That garment was made of cotton duck with cotton bias binding around its periphery and it lost its shape during industrial laundering and had poor wear resistance both during laundering and during its intended use when worn to protect a person. It had a narrow elastic belt at each side of the body to interconnect front and rear parts of the vest. However, the belt would not remain flat when worn and was attached to the straight sides of the garment so that the forces from the belt were not distributed widely over a large vertical extent at both sides of the front and rear panel portions of the garment. Also, the relationship of insulating, reflective and heat absorptive materials was such that the heat was first intercepted by the insulation before it could be reflected and the reflective material was perforated so that not only was its surface not completely reflective, but also it permitted slight passage of heat therethrough by convection after the heat penetrated the insulation. Moreover, the in was in vertically spaced sections within the areas of the pockets and did not cover pocketed areas on the front and back of the garment. The insulation sections were significantly smaller than the periphery of the pockets and were not directly fastened to any other portion of the garment and could move around in the pockets and even curl up therein during laundering. Thus the insulation did not remain in fixed in alignment with the gel packets so that during use there were portions of the gel packets which were not protected by the insulation and there were spaces between the packets coinciding with spaces between the insulating sections where the only significant heat interceptor between the heat source and the worker was the perforated reflective material.

SUMMARY OF THE INVENTION

In accordance with the preferred embodiment of the invention a heat-intercepting shield or shroud in the form of a vest-like garment has a fabric shell within which are formed a plurality of adjacent pockets which are generally horizontal when the garment is worn. The shell has similar front and rear panel portions which cover most of the human torso. These portions each comprise two generally coextensive fabric layers which extend from the shoulder line to the bottom of the garment. These layers are stitched together to define pockets to receive replaceable packets of refreezable material which are capable of absorbing substantial quantities of heat as the material melts. Over the entire area of the pockets on both the front and back panel portions of the garment and next to the outer fabric layer are coextensive layers of non-breathable essentially-continuous reflective material and of insulating material. These materials are stitched next to the outer layer of fabric in the seams defining the pockets so that both heat reflection and retardation of heat flow by the insulation occurs over the entire pocketed areas. Progressing from the exterior heat source toward the wearer the layers inside the fabric shell include a heat-reflective layer, an insulating layer which provides further protection from the heat which penetrates the reflective layer and a layer formed by the heat-dissipating packets of frozen gel material. Manufacture of the garment is greatly facilitated and the garment made much more economical in both manufacture and in use by a linear arrangement of hook and loop fastening means which forms the closure for each of the pockets and extends continuously from the bottom of the front shell portion up and over the shoulder and down the rear of the other shell portion to the bottom thereof. Each pocket closure is conveniently opened by grasping a tab attached to one part of the fastening means near the middle of the closure and pulling it away from the adjacent shell portion to which the opposite portion of the closure means is attached.

The features of this invention may be embodied in a heat intercepting shield or shroud covering and cooling only a portion of the body such as the kidneys when the required stay period under hostile heat conditions is shorter. In such cases it is practical having a single pocket covering the kidneys and containing a single refreezable packet of heat dissipating material.

A garment having two horizontal generally end-to-end pockets may be used around the waist of a person while still facilitating the wearing of an air tank or other apparatus on his back to support breathing in a hostile hot environment.

A garment having heat-intercepting areas at both the chest and back of the wearer may be made with separately removable parts or panels to facilitate replacement of one or more parts or panels when the wearer is also wearing other safety or breathing equipment which is inconvenient to remove or which must be kept in use while the wearer is in the hostile environment.

The features of the invention may also be embodied in a heat intercepting blanket made up of a plurality of rows and columns of pockets each utilizing the same relationship of layers of heat reflecting, heat insulating and heat dissipating materials as mentioned above.

Further features of the invention are found in particular structural and material details set forth in the detailed description of the invention hereinafter.

DESCRIPTION OF THE PREFERRED EMBODIMENT

Figure 1:
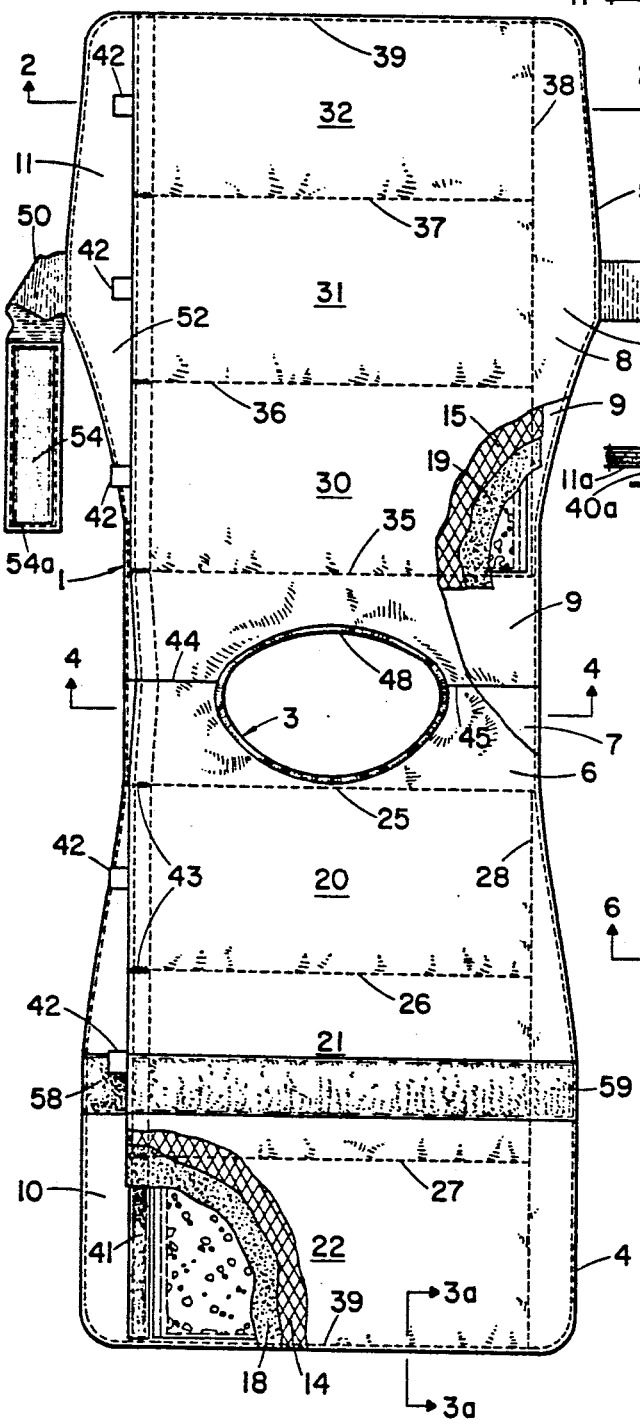
FIG. 1 is a plan view of a vest-like garment in accordance with the invention with the garment spread out flat and partially cut away at two places to more clearly illustrate interior features of the garment.

In the preferred embodiment of FIG. 1 a vest-like garment 1 has two main panel portions located above and below the neck opening 3, respectively. The portion shown below the neck opening 3 forms the front panel 4 of the garment when it is worn and the portion in the drawing above the neck opening 3 is the rear panel 5 of the garment. The exterior of the garment is a essentially a casing in which the exterior of the front panel is formed primarily by fabric members 6 and 7 and the exterior of the rear panel is formed primarily by the fabric members 8 and 9. Along the left side of the garment as seen in FIG. 1 the facing fabric strips 10 and 11 form outer face portions on the front and rear panels 4 and 5, respectively.

Within the garment and next to the outer panel members 6 and 8 are located flexible layers 14 and 15, respectively, of heat-reflective material. Further to the inside of the garment and next to the reflecting layers are flexible layers 18 and 19, respectively, of heat-insulating material.

Figure 3:
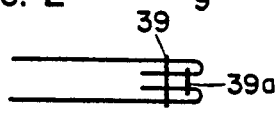
FIG. 3 is an enlarged section corresponding to the extreme right end of FIG. 2 and showing greater detail of the stitching at the periphery of the garment.
Figure 3A:
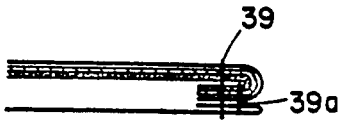
FIG. 3*a* is an enlarged section taken on line 3*a*—3*a* of FIG. 1 and like FIG. 3 shows greater detail of the peripheral stitching.

The multiple layers of fabric and the heat-reflective and heat-insulating materials are stitched together to form a series of side-by-side pockets 20, 21 and 22 in the front garment panel 4 and a series of side-by-side pockets 30, 31 and 32 in the rear garment panel 5. As seen in FIG. 1 the upper sides of the pockets 20, 21 and 22 are formed by stitched seams 25, 26 and 27 and the lower sides of the pockets 30, 31 and 32 are formed by stitched seams 35, 36 and 37. The right ends of the pockets 20, 21 and 22 are formed by a single straight stitched seam 28 and the right ends of the pockets 30, 31 and 32 are formed by a single straight stitched seam 38. The outer sides of the outer pockets 22 and 32 are portions of a stitched seam 39 extending around the entire periphery of the garment. During assembly of the garment many of the layers of material are stitched together while the garment is essentially inside out and an initial seam 39*a* as seen in FIGS. 3 and 3*a* is stitched. Thereafter the garment is turned right side out and the final seam 39 is stitched and the seam 39*a* remains concealed but adds significant strength to the periphery of the garment.

Extending along the entire length of the garment at the left end of each of the six pockets 20, 21, 22, 30, 31 and 32 are cooperating parts of an elongated hook and loop fastener comprising a hook strip 40 fastened together with the edges of the fabric member 6 and the reflective and insulating layers 14 and 18 by stitching. The other fastener part is a loop strip 41 which is fastened to the fabric members 7 and 9 also by stitching in a position where it covers the adjacent edge of the facing strips 10 and 11. The left ends of the six pockets are closed by means of the cooperating portions of the strips 40 and 41 which extend therealong. The pocket closures formed by the strips 40 and 41 are each easily and independently opened by means of a small fabric pull tab 42. Each tab is fastened by stitching near the center of the pocket opening at the back of the hook strip 40 between it and the overlying fabric members 6 and 8, preferably between the hook strip and the reflective layers 14 and 15. At the ends of each pocket opening there are bar-tacks 43 stitched through the entire garment thickness for reinforcement.

Figure 4:
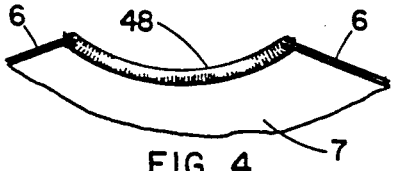
FIG. 4 is a section taken on the line 4—4 in FIG. 1 showing features of the neck portion of the garment.

The fabric members 6 and 8 are stitched together at the shoulder seams 44 and 45. The fabric members 7 and 9 are similarly stitched together at shoulder seams. The edges of the four fabric members at the neck opening are bound together by means of a ribbon member 48 folded over the edges and stitched thereto as seen in FIGS. 1 and 4. The ribbon 48 is a grosgrain ribbon of 100% nylon which is extremely wear-resistant, will not shrink, will not fray and is heat sealable at its ends when cut with a hot knife before stitching it in place.

The garment is held in place when worn by a person by means of an elastic belt. The belt comprises two wide non-roll elastic strips 50 and 51 which are fastened by stitching at the scalloped areas 52 and 53 which form extensions of the casing beyond the ends of pocket 31 at opposite sides of the rear panel of the garment. These extensions cooperate with the securing belt to distribute the holding or securing forces across the entire width of the respective ends of the pocket so that the latter and the packet therein are held in good heat transfer relationship against the body. One end of the strip 50 is anchored in the peripheral seam 39 between fabric member 8 and the facing member 11. One end of the other strip 51 is similarly anchored between the fabric members 7 and 9. The other ends of these strips can be fastened to the front garment panel by means of identical cooperating hook strips 54 and 55. These hook strips are carried on the inner faces of the belt end portions 54*a* and 55*a*, respectively, the strip 55 being on the hidden side of end portion 55*a* in FIG. 1. These hook strips are permanently. attached to the ends of elastic straps 50 and 51 and are detachably secured to loop strips 58 and 59 extending across the entire of the front panel 4. The loop strip 58 is stitched on top of the facing strip 10 between seam 39 and the long loop strip 41. The other loop strip 59 is stitched in place around its periphery to overlie the pocket 21, extending near the center and along the length thereof and beyond the seam 28 to the edge of the fabric member 6. To position the garment for use on a person, the neck opening is slipped over the head and the belt portions are slightly tensioned by pulling on the hook strips 54 and 55 and fastening these strips by engaging their hooks with the loops of the loop strips 58 and 59 on the front panel of the garment. The lengths of the hook and loop strips 54, 55, 58 and 59 together with the elasticity of the straps 50 and 51 provide a very wide range of adjustment of the belt so that one size of the garment fits most workers. The elastic straps 50 and 51 are made with raised transverse ribs to give its non-roll feature. The straps 50 and 51 can be stretched to twice their unstressed length of about five inches.

Although the garment 1 by itself can provide some protection to the worker from a heat source, it is intended to provide a much higher level of heat protection by receiving flexible heat-dissipating refreezable packets 60 in the pockets 20, 21, 22, 30, 31 and 32. As seen most clearly in FIGS. 5 and 6, the multi-segment packet 60 is formed from a heat-sealable transparent plastic tube 61 having four seams thereacross which define three equal-size generally flat sealed compartments. The flexibility of each packet 60 at the seams between the compartments allows the front and rear panels of the garment to conform to the person's body to provide greater comfort and more freedom of movement when the garment is worn.

The plastic tube 61 is made of polyethylene of about 4 mil thickness which is easily sealed to itself to form seams merely by the application of sufficient pressure and heat. The tube may be made of a tougher material such as polyvinyl chloride and the seams formed by electronic welding. A tougher material of this nature may be preferred for use in the embodiment of FIG. 8 where the blanket illustrated may be used as a mat on which workers walk. The tube 61 may be aluminized to make it and the packets 60 reflective on the outer side for additional heat interception.

Each of the compartments of packet 60 contains a refreezable heat dissipating means in the form of a pack 63 of refreezable non-toxic chemical refrigerant gel. Although the pack 63 is shown as gel in a single-compartment flexible plastic envelope, each pack can be made as a multi-compartmented envelope to provide more flexibility when frozen. However, the illustrated packs are more economical to manufacture and can contain more of the gel within each of the compartments of the packet 60. The gel freezes at a temperature of about 0 degrees C. Its heat of fusion is has a value approximately 10% or more in excess of the heat of fusion of water. It compares very favorably with the value of water which is 80 cal./g./deg.C. at 0 degrees C. The gel is also much more viscous than water when melted and is much less likely to escape from the packet 60 in the event of accidental puncturing of the packet tube the envelope of the gel pack 63.

The size of each of the pockets 20, 21, 22, 30, 31 and 32 in the garment panels is about 6 by 13.25 inches. The packets are about 5.75 by 13.25 inches with a thickness of about ¾ inch. The size of each refreezable pack is only very slightly less than the size of the compartments.

Throughout this specification the term fabric preferably refers to a woven material which has a weight of about five ounces per square yard and is made of 65% polyester and 35% cotton. This material can absorb moisture of condensation, retains its shape, has minimum shrinkage and is very durable and wear-resistant. However, in some applications where flammability of the garment is a consideration, the fabric may be of a fire retardant material such as that commercially available under the name "Nomex."

The insulating material used in the various embodiments of the invention is preferably a polyester fleece material which has a thickness of about 3/16 inch and a weight of about 9 ounces per square yard.

The heat-reflective material used in this invention preferably has an extremely thin shiny metallic non-breathable surface layer on the heat receiving side. This surface layer is carried by a thin layer of insulating foam material which is backed by a very thin plastic sheet layer. This structure of the material, its smooth surfaces and its resistance to any significant stretching makes it very suitable for stitching together with the other components used in the illustrated embodiments. These three layers are bonded together along spaced crossed lines. The bonded area is only a small percentage of the surface area of the reflective material. This material has a thickness of about 1/25 inches and an insulating factor of R2.

Figure 7:
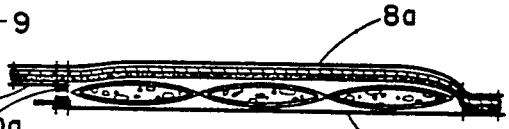
FIG. 7 is a section corresponding generally to FIG. 2, but illustrating a modification of the invention.

Another embodiment of the invention is shown in FIG. 7 wherein the fabric layer 8*a* extends to the left edge of the garment and the insulating and heat-reflecting layers extend to opposite sides of the garment. The peripheral seams are then like the seam in FIG. 3*a*. Also, a facing strip 11*a* corresponding to strip 11 of FIG. 1 is now on the underside of the insulation and stitched between it and the hook portion 400 of the fastener. The bottom fabric member 90 is reduced in width by an amount corresponding to the width of the strip 11*a*. The belt members are attached essentially as in FIG. 1 to the edges and front face of the garment.

Figure 8:
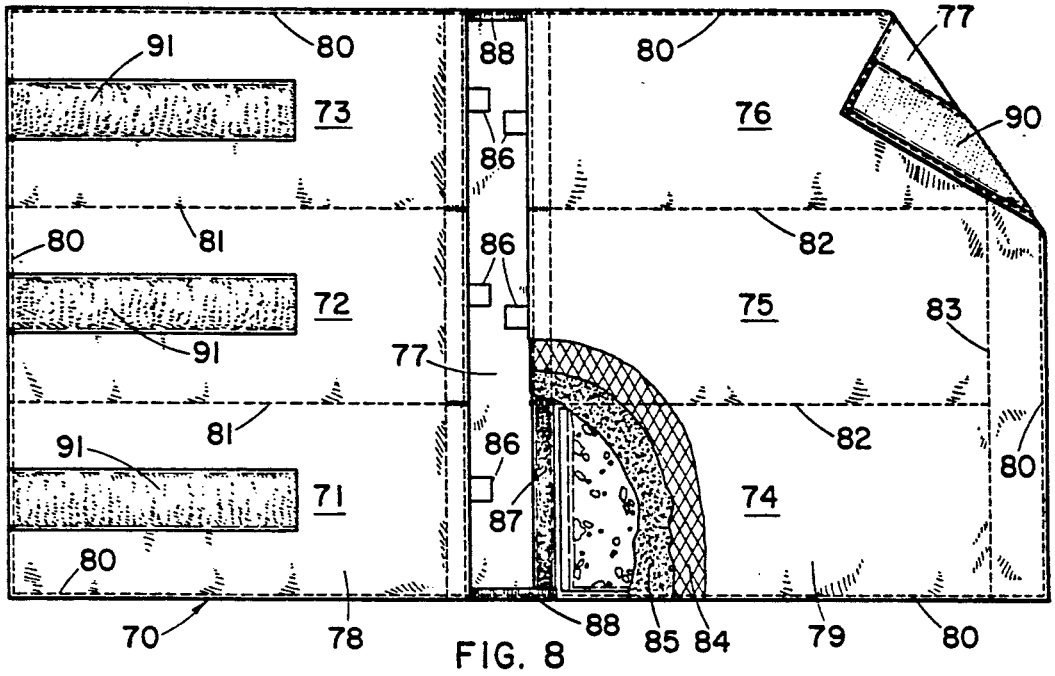
FIG. 8 is a plan view of another embodiment of the invention illustrating a heat-intercepting blanket with a portion cut away and a corner turned over to show a portion of a fastener thereon.
Figure 9:
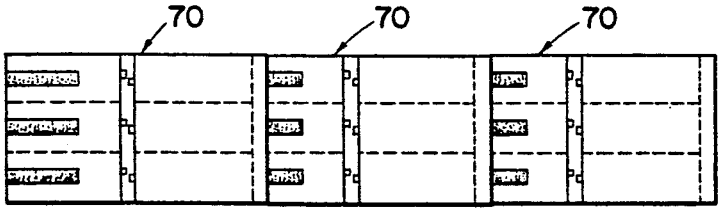
FIG. 9 is a plan view of an embodiment of the invention wherein three blankets as shown in FIG. 8 are fastener together to form a larger blanket.
Figure 10:
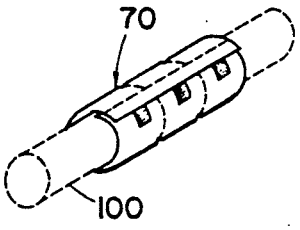
FIG. 10 is a perspective view of a blanket of the type shown in FIG. 8 wrapped around an object (in dotted lines) to be cooled.

Another embodiment of the invention is shown in FIGS. 8, 9 and 10 wherein a heat-intercepting or cooling shield or shroud is made in the form of a flexible blanket 70. Similar to the previously described garment 1, the blanket 70 as seen in FIG. 8 has a plurality of elongated flat equally-sized generally co-planar elongated pockets 71 through 76 for receiving refreezable packets 60 identical to those used with the garment 1. These blanket pockets are about 6¼ by 14½ inches. The blanket 70 has a rear fabric face member 77 essentially coex size with the blanket. The fabric member 77 forms the rear wall of each through 76. A smaller fabric face member 78 is generally coextensive with and forms the front face of one group of side-by-side elongated pockets 71, 72 and 73. Another fabric face member 79 forms the front face of another group of side-by-side elongated pockets 74, 75 and 76. The fabric members 77, 78 and 79 are all rectangular and adjacent sides of the members 78 and 79 are spaced from each other about two inches across the width of the blanket near its center. The other three sides of the fabric members 78 and 79 are secured to the periphery of the fabric member 77 along a peripheral seam 80 which extends around the entire edge of the member 77. Details of this seam regarding initial stitching inside out correspond to the seam details shown in FIGS. 3 and 3*a* for the garment of FIG. 1. This seam 8 defines the outer sides of pockets 71, 73, 74 and 76. The outer ends of pockets 71, 72 and 73 are formed by the straight portion of the seam 80 at the left end of the blanket as seen in FIG. 8. The outer ends of the pockets 74, 75 and 76 are formed by a seam 83 which is spaced from the seam 80 at the right edge of the blanket as seen in FIG. 8. Seams 81 divide the left side of the blanket into the three equally sized pockets 71, 72 and 73. Similarly, the seams 82 divide the right side of the blanket into the three equally sized pockets 74, 75 and 76.

Next to or just under each of the fabric members 78 and 79 are two successive layers of heat-reflective material 84 and heat-insulating material 85, shown only at the cut away area of FIG. 8. In the preferred embodiment these layers for pockets 74, 75 and 76 end in the seam 83, but they may be extended beyond seam 83 to be stitched in the edge seam 80. The ends of the pockets 71 through 76 extending across the center of the blanket have closures thereat formed by fastening means comprising cooperating two pairs of hook and loop strips like the strips 40 and 41 in the embodiment shown in FIGS. 1 and 2. Each hook strip is similarly stitched along and under the edge portions of one of the fabric members 78 and 79 with the edges of the layers of reflecting and insulating material 84 and 85 therebetween. Pull tabs 86 are also stitched therein between the hook strips and the insulating material layers 85. Each of the loop strips 87 is stitched across the fabric member 77 directly beneath its cooperating hook strip. Protective ribbon material 88, like the ribbon 48 in FIG. 1, is stitched over the edge of fabric member at both sides of the blanket between the fabric members 78 and 79. The space between the members 78 and 79 may be covered across the center of the blanket by successive layers of insulation and reflective material and another layer of fabric stitched atop the fabric 77 with the edges of these additional layers stitched under the loop strips 87 and with their ends under the ribbon strips 88.

Extending over the fabric member 77 at area on he back side of the blanket at the right end between the seam 83 and the peripheral seam 80 is a two-inch wide hook strip portion 90 of a hook and loop strip fastener means. This loop strip is at the outer ends of and extends transversely with respect to the elongated pockets 74, 75 and 76. This strip cooperates with three two-inch wide loop strip portions 91 of the fastener means located on the opposite or front side of These loop portions are stitched to the front of the fabric member 78 and each extend the peripheral seam 80 at the left and about two thirds of the distance down the center of the pockets 71, 72 and 73 toward the closure ends of these pockets. The blanket 70 can be wrapped around all or a portion an object 100 (in dotted lines) to be cooled and held in place by pressing the hook strip 90 into engagement with the loop strips 91 as shown in FIG. 10. Two or more blankets can be connected together by engaging the hook strip of one blanket with loop strips of another as seen in FIG. 9 where three blankets 70 are connected together. One or multiple blankets can thus be wrapped and fastened about objects of varying size and shape for either cooling the objects or for protecting them against environment heat. One or more blankets can also be used as mats on hot walkways to protect the feet of workers. In such case the heat reflective material is on the side of the blanket toward the hot surface.

Figure 5:
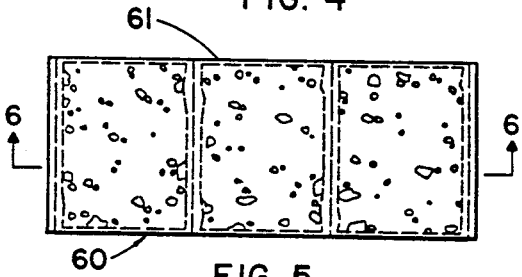
FIG. 5 is a plan view of a packet of heat-dissipating refreezable material used with the present invention.
Figure 6:
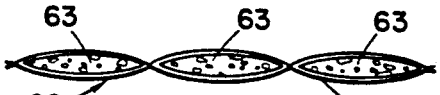
FIG. 6 is a section taken on the line 6—6 in FIG. 5.

Each of the pockets 71 through 76 contains one of the removable heat-dissipating packets 60 shown and described in connection with FIGS. 5 and 6. The space between the fabric members 78 and 79 is about two inches wide. The blanket can be suspended on the narrow edge of a horizontal two by four inch board (not shown) with the groups of side-by-side pockets hanging narrowly spaced on opposite sides of the board to facilitate inserting the packets 60 into open ends of the pockets, which, in the hanging position, all lie along one side of the blanket shield. The tabs 86 are pulled to open the hook and loop closure for each pocket to permit insertion of the packets 60 whereafter the hook and loop portions are pressed together to keep the packets in place. The two groups of pockets are loaded alternately so that the weight of the packets will not cause the blanket to fall off the support. The individual packets cover essentially the entire area of the respective pockets.

Figure 11:
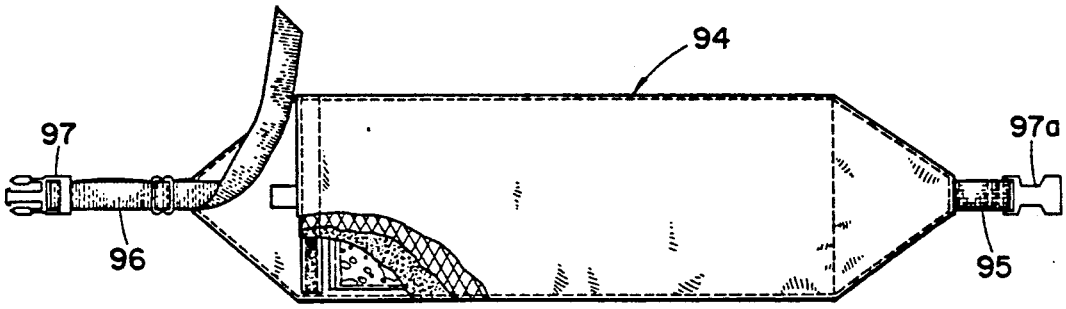
FIG. 11 is a partially cut away plan view of another modification of the invention illustrating a heat-intercepting belt having a single pocket for holding a heat dissipating packet.

In the embodiment of the invention shown in FIG. 11 a belt structure 94 is provided with only a single pocket with the multilayer relationship and construction therefor essentially the same is previously described and with the peripheral side and end seams essentially the same as shown in FIGS. 3 and 3*a*. Triangular extension portions of the casing are formed beyond the ends of the pockets for attachment of belt means comprising an elastic non-roll strap 95 about one inch wide and a few inches long and an adjustable length non-elastic strap member 96 which is looped through one part 97 of a side-release buckle. These extensions cooperate with the securing belt to distribute the holding or securing forces across the entire width of the respective ends of the pocket so that the latter and the packet therein are held in good heat transfer relationship against the body. The strap 95 is looped through the other cooperating part 97*a* of the buckle. The other ends of the straps 95 and 96 are stitched in the ends of the triangular portions of the belt.

Figure 12:
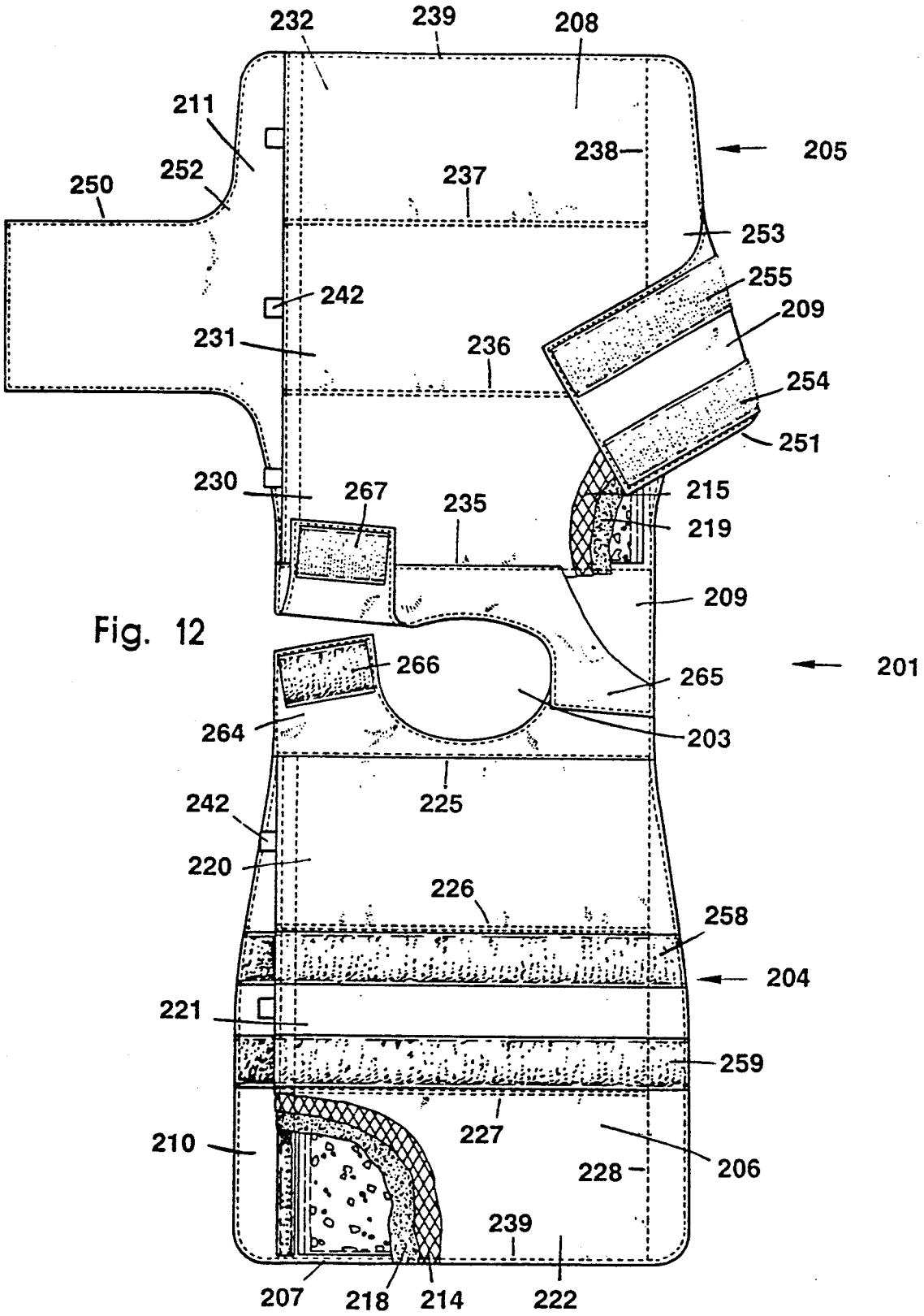
FIG. 12 is a plan view of an alternative two-piece vest-like garment in accordance with the invention with the garment spread out flat and partially cut away at two places to more clearly illustrate interior features of the garment.

An alternative embodiment of a vest-like garment in FIG. 12 is described below using for the most part the same reference numerals as in FIG. 1 for similar or corresponding parts, but with 200 added thereto alternative embodiment of FIG. 12 a vestlike garment 201 has two readily separable panel portions located above and below the neck opening 203, respectively. The portion shown below the neck opening 203 forms the front panel 204 of the garment when it is worn and the portion in the drawing above the neck opening 203 is the rear panel 205 of the garment. The exterior of the garment is a essentially a casing in which the exterior of the front panel is formed primarily by the outer fabric member 206 terminating at the seam 225 and an inner member 207 similar to fabric members 6 and 7 of FIG. 1. The exterior of the rear panel is formed primarily by the outer fabric member 208 which terminates at the seam 235 and the inner fabric member 209. Both inner fabric members are of shapes corresponding to the outline of the respective front and rear panels respectively. Along the left side of the garment the facing fabric strips 210 and 211 form outer face portions on the front and rear panels 204 and 205, respectively. The shoulder portions 264 and 265 of the front and rear panels 204 and 205, respectivley, on either side of neck opening 204 are made separable by use of a hook and loop fastener approximately 2 inches in width with a loop portion 266 secured to the outside surface of the shoulder of the front panel. The hook portion of the fastener 267 is secured to the inside surface of the shoulder portion of the rear panel. The shoulder portion 265 of the rear panel is sufficiently long to pass over the shoulder of a wearer and overlap the shoulder portion 264 of the front panel so that each two part fastener securing the front panel to the rear panel at the shoulders is located in a position to the front of and slightly below the shoulder and is readily accessible to a wearer of the garment.

Within the garment and next to the outer panel members 206 and 208 are located flexible layers 214 and 215, respectively, of heat-reflective material. Further to the inside of the garment and next to the reflecting layers are flexible layers 218 and 219, respectively, of heat-insulating material.

The multiple layers of fabric and the heat-reflective and heat-insulating materials are stitched together to form a series of side-by-side rectangular pockets 220, 221 and 222 in the front garment panel 204 and a series of side-by-side rectangular pockets 230, 231 and 232 in the rear garment panel 205. As in FIG. 1 all pockets are of equal size. As seen in FIG. 12 the upper sides of the pockets 220, 221 and 222 are formed by stitched seams 225, 226 and 227 and the lower sides of the pockets 230, 231 and 232 are formed by stitched seams 235, 236 and 237. The right ends of the pockets 220, 221 and 222 are formed by a single straight stitched seam 228 and the right ends of the pockets 230, 231 and 232 are formed by a single straight stitched seam 238. The outer sides of the outer pockets 222 and 232 are formed by portions of the stitched seams 239 extending around the periphery of the garment. Seams 226, 227, 236 and 237 are stitched using a double needle machine to provide additional seam strength and eliminate the need for the bar tacks 43 as shown in FIG. 1.

Figure 2:
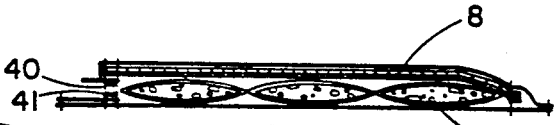
FIG. 2 is a section taken on the line 2—2 in FIG. 1.

Extending along the length of the garment along a line at the left end of each of the pockets 220, 221, 222, 230, 231 and 232 are cooperating parts of elongated hook and loop fasteners, like those of FIGS. 1 and 2, each comprising a hook strip fastened together with the edges of the outer fabric members 206 and 208 an the reflective and insulating layers 214, 215 and 218, 219 by stitching. The other fastener parts are loop strips which are fastened to the fabric members 207 and 209 also by stitching, each in a position where it covers the adjacent edge of the facing strip 210 or 211. The left ends of the six pockets are closed by means of the cooperating portions of the fastener strips which extend therealong. The pocket closures formed by the fastener strips are each easily and independently opened by means of a small fabric pull tab 242. Each tab is fastened by stitching near the center of the pocket opening at the back of the hook strip between it and the overlying fabric members 206 and 208.

The sides of the garment are held in place when worn by a person by means of inelastic wing-like belt portions. The belt portions comprise two wide strips 250 and 251 which are further extensions of the scalloped extension areas 252 and 253 beyond the ends of pocket 231 at opposite sides of the rear panel of the garment. The width of the belt portions 250 and 251 are approximately the width of the pocket 231. The outer ends of each of these belt portions 250 and 251 can be fastened to the front garment panel by means of a pair of generally parallel hook strips 254 and 255 attached along the opposite edges of belt portions 250 and 251 from their outer ends to the ends of pockets 231 and pairs of loop strips 258 and 259 extending across the entire front of the front panel 204 generally along the upper and lower edges of pockets 221. The left end portions of loop strips 258 and 259 are stitched on top of the facing strip 210 between the seam 239 and the long loop strips 241. The other parallel portions of loop strip 238 and 259 are stitched in place around their periphery to overlie upper and lower portions of pocket 221 and extending along the length thereof and beyond the seam 228 to the right edge of the fabric member 206 as seen in FIG. 12. The scalloped and wing-like extensions of the casing beyond the ends of pocket 231 cooperate with the hook and loop fasteners to form a securing belt to distribute the holding or securing forces across the entire width of the respective ends of the pockets 221 and 231 so that the latter and the packets therein are held in good heat transfer relationship against the body. To position the garment for use on a person, the neck opening is slipped over the head and the belt portions are slightly tensioned by pulling on the belt portions 250 and 251 and fastening the hook strips thereon with the loops of the loop strips 258 and 259 on the front panel of the garment. The lengths of the hook and loop strips 254, 258 and 259 on the belt portions 250 an 251 provide a very wide range of adjustment of the belt so that one size of the garment fits most workers.

During assembly the outer members 206 and 208 are stitched together with the reflective and insulating layers and the yokes along seams that will be hidden along the se 235. During this initial stitching the ultimately exposed outer faces of the yokes the areas of the outer members 206 and 208 corresponding to pockets 220 and 230. After the initial stitching the yokes are folded back on themselves at the initial seam to be essentially coplanar with the members 206 and 208, but on opposite sides of the initial seam. The initial seam would be like seam 39*a* in FIG. 3*a*. The components of the respective panels 204 and 205 are then stitched together around their periphery and inside out with initial seams like the seams 39*a* of the French seams of FIGS. 3 and 3*a*, but leaving in each panel an unstitched area, for example at one of the shoulder seams. The panels are turned right side out through the unstitched shoulder area and the shoulder seam thereafter stitched and reinforced when the fastener strips for the shoulder connections are added by stitching. Stitching secures the loop fastener strips over the edges of the fabric members 210 and 211 and to the respective inner fabric members to define the left ends of the several pockets as seen in FIG. 12. The edges of the outer members are folded over the edges of the reflecting and insulating layers along the hook fastener strips, covered by the latter and these several layers stitched together along with the tabs 242 along the entire length of the hook strips. Double stitching is added through all the layers of the garment to define the upper and lower edges of the pockets 221 and 231. The seams 239 are stitched around the periphery. The seam like 39*a* remains concealed but adds significant strength to the periphery of the garment. Additional stitching along seams 225 and 235 through all layers of the panels will define the upper edges of the pockets 220 and 230 and seams 228 and 238 are added through al layers of the panels to define the right ends of the several pockets as seen in FIG. 12.

Figure 13:
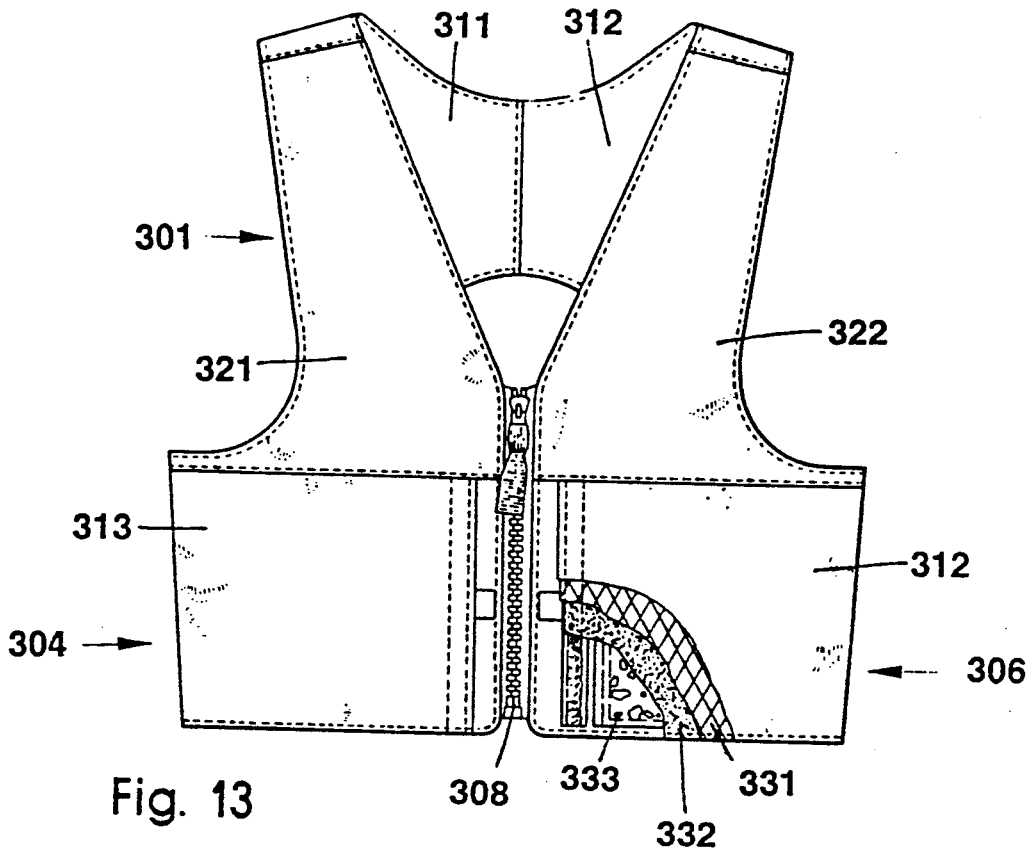
FIG. 13 is a front view of a vest-like garment having two horizontal end-to-end heat-intercepting areas extending around the sides of the wearer near the waist.
Figure 14:
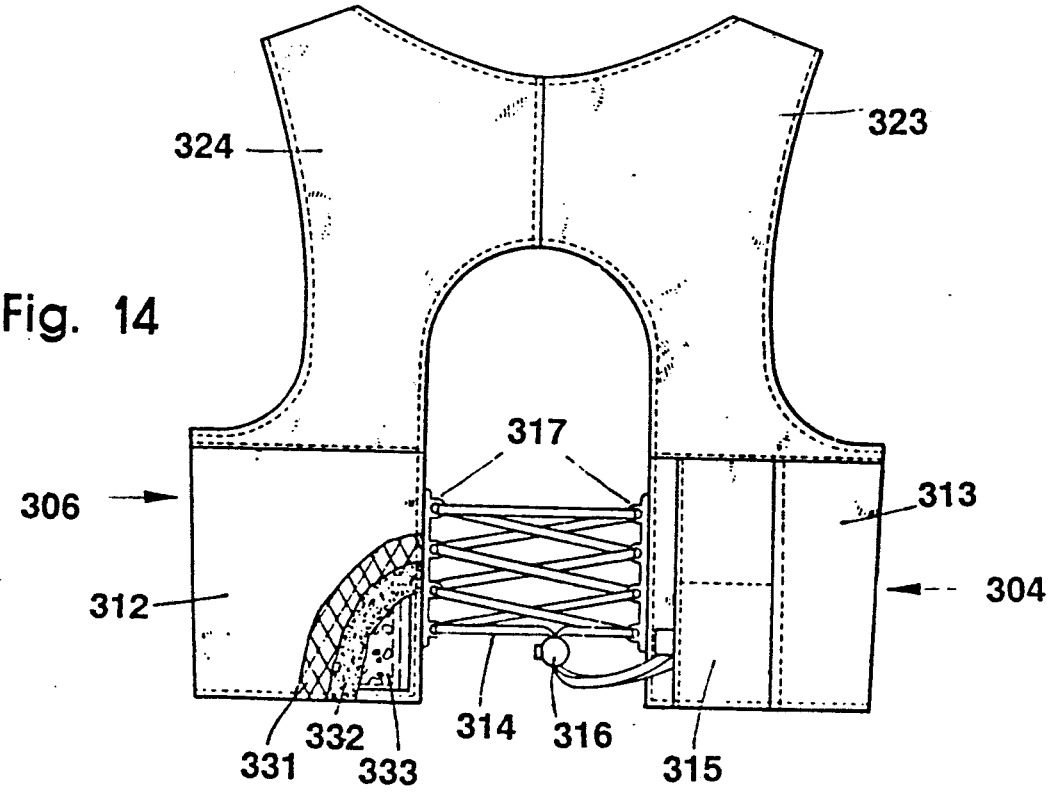
FIG. 14 is a view showing only the rear portion of the vest-like garment of FIG. 13.

In the embodiment of the invention in FIGS. 13 and 14 a vest structure 301 has the same general arrangement of layers of fabric casing, reflective material, insulating material and heat-dissipating packets as in the above disclosed embodiments. This vest has two horizontally extending equal sized pockets 304 and 306 which are end to end near the front center of the vest and extend to opposite sides and partially around toward the back near the waist of the wearer. At the front, the entire width of the adjacent ends of the vest pockets are interconnected by means of a zipper fastener 308 of low heat conductivity. The zipper does not add to the thickness of the vest as do the overlapping belt-like fasteners of FIGS. 1 and 12. This is an advantage in improving comfort and reducing interference when such a vest is used with an air pack to support breathing in a hostile environment.

The casing of the vest 301 is made up principally from eight fabric members which are stitched together to provide wear resistant tough strong French seams around the entire periphery of the vest. The entire inner facing of the vest casing is formed by two fabric panel members 311 and 312 which are joined together at the rear center around the inside of the vest to the front center where they terminate at opposite zipper. These panels form the inside walls of the pockets 304 and 306. The outside of the pocket structures are formed primarily by rectangular fabric panel members 312 and 313 which extend to the pocket openings at the front. The panel 312 extends around the left side of the garment to the adjustable elasticized corset-like laced interconnection 314 between the sides of the vest at the rear center. The panel 313 extends around to the back where it joins a folded small fabric member which is stitched to provide a small pocket 315, on the outside of and about half the height of the pocket 304, with an opening facing the laced interconnection 314 to receive and confine excess end portions of the elastic lacing thereof. The opening is provided with a suitable hook and loop fastener to retain the excess lacing in the pocket when the vest is being used. The lacing threads through eyelets at each side of the connection 314 and is secured in an adjusted position by any well known cord tie 316. The eyelets are in commercially available plastic strips 317 designed to be stitched into the seams of the casing defining the rear ends of the pockets. These strips 317 extend over a major portion of the vertical extent of the rear ends of the pockets 304 and 306 so that the lacing will provide a large area of support at the back of the wearer to distribute across the ends of the pockets the forces which hold the packets to the body, to support the weight of packets in the pocket of the vest and keep them snug against and in good heat transfer relationship with the wearer's body as various positions are assumed during use of the vest. The zipper similarly supports the front ends of the refrigerant pockets. The relatively heavy refrigerant pockets are just like the packets of the other embodiments.

The outer surfaces of the casing of the vest in the area of the shoulders is formed by the fabric yoke pieces 321 and 322 at the front and 323 and 324 at the rear. These front and rear pieces are joined at each side near the top of the shoulder and the rear pieces are joined at a vertical seam at the rear center of the vest at approximately shoulder blade height.

The cut-away areas of FIGS. 13 and 14 show portions of the reflective layer 331, the insulating layer 332 and the refrigerant packet 333 in the pocket 306. The adjacent ends of the pockets 304 and 306 at the front of the vest have openings which face the zipper 308 and which are closely to closely retain the packets therein by hook and loop fasteners like those of the other embodiments and similar tabs are provided at the center of each opening to facilitate opening of the pocket to insert or remove the refrigerant packet.

To assemble the various fabric parts of the vest of FIGS. 13 and 14 the members 311 and 312 are stitched together along the vertical rear center to form a vest-like subassembly. The outsides of the pockets 304 and 306 are stitched together with the reflective and insulating layers and the outer hook strips of the pocket closure fasteners. The yoke p together at the shoulders, armpits and the vertical rear center. After the assemb pieces are stitched to the outsides of the pockets there exist two vest-shaped subassemblies which will be stitched together inside out to provide further seams along with those stitched areas just mentioned which will be hidden stitching in the completed garment. While stitching inside out the zipper and the plastic eyelet strips are installed. The vest is later turned right side out through a pocket opening. The hidden armpit seams are stitched via access through this pocket opening and after all the hidden stitching is completed the armpits and other peripheral seams are overstitched and the inner and outer vest layers are overstitched along the tops of the pockets and the pocket opening fastener loops are stitched over the small facing strips along the sides of the zipper and to the back or inner walls of the pockets.

The vest of FIGS. 13 and 14 may be loaded with frozen packets by laying it on a flat surface so that the pockets overlie one another with the openings therein facing the same direction. Alternatively the vest may be hung with the zipper closed and horizontal and resting on the upper edge of a suitable narrow support whereby the upwardly opening pockets would again be at the same side of the garment and could then be filled from above.

Another embodiment of the invention provides a helmet garment which is similarly constructed to fit over the head and neck of a worker. It uses the same relationship of fabric members, gel packets and insulation and reflective layers to protect the head and neck from the shoulders up. It has a plurality of narrower and shorter pockets with closures on the outside to receive the gel packets. This garment must be sufficiently loosely fitting about the head and neck to permit turning and nodding movement without inconveniencing or annoying the wearer.

Other variations within the scope of this invention will be apparent from the described embodiments and it is intended that the present descriptions be illustrative of the inventive features encompassed by the appended claims.

What is claimed is:

1. A shield comprising heat-intercepting means wrappable in a circumferential direction around at least a major portion of an object for protecting a portion of said object against an external source of radiant, conductive and convective heat comprising a flexible casing having front and rear flexible fabric members, said members being secured together and providing a plurality of elongated rectangular facial heat-intercepting areas of equal size extending in said circumferential direction and constituting essentially the primary heat-intercepting means at the exterior of said shield, each said area having four peripheral sides and generally rectangular corners, said shield having within said casing throughout each said area three layers comprising, successively, in the direction away from the source of said heat, a flexible layer of heat-reflective non-breathable material, a flexible layer of heat-insulating material, and a generally flat flexible multi-sectioned removable and replaceable packet layer of heat-dissipating material for absorption of heat, said packet layers being of the same size and covering an area substantially coextensive in size with the respective heat-interception each of said three layers for each area being between two respective flexible casing members with said heat-reflective and said heat-insulating layers being permanently stitched to both of the flexible members along two parallel sides and a third side of the periphery of the respective heat-intercepting area, the three parts comprising said heat-reflecting and heat-insulating layers and one of said flexible casing members being permanently stitched to each other along the fourth side of said respective area, and manually separable means for releasably securing said three parts to the other flexible member along the entire fourth side of each said area to permit removal and insertion of a respective packet and to enclose and to closely confine said packet layer of heat-dissipating material against movement relative to said periphery, said shield being supportable when separated from the object to be protected in a position wherein said manually separable means for all said areas area arranged with respect to each other whereby all said packets may be inserted into said shield along parallel paths in a common direction, said heat reflecting and heat insulating layers each being unattached to one another and unattached to either of said flexible members over the area of each packet layer within said four sides at each heat-intercepting area.

2. A shield according to claim 1 wherein there is at least one area of said heat-intercepting means comprising a plurality of said facial heat-intercepting areas arranged side-by-side with adjacent sides of adjacent said heat-intercepting areas being defined by a common seam forming one of said parallel sides of each of the adjacent areas.

3. A shield according to claim 1 wherein there is at least one pair of said heat-intercepting areas arranged end-to-end when wrapped around said object and said shield is foldable to said position wherein said packets may be inserted into the shield in said common direction.

4. A heat-intercepting field for controlling the temperature of a portion of an object, said shield comprising a flexible casing having front and rear flexible members, said members being secured together and providing at least one facial primary heat-intercepting area of said shield, each said primary area having four sides and generally rectangular corners and being divided into a plurality of elongated four-sided rectangular smaller heat-intercepting areas, all such smaller heat-intercepting areas being identical in size, said shield having within said casing throughout each of said smaller areas three successive layers comprising in order a flexible layer of heat-reflective non-breathable material, a flexible layer of heat-insulating material, and a third layer comprising for each smaller area a flexible multi-sectioned packet of heat-dissipating material for absorption of heat, said flexible layers of heat-reflecting and heat-insulating materials each being at least coextensive over each respective said primary heat-intercepting area, said three layers being between the flexible casing members with said heat-reflective and said heat-insulating layers being stitched to both of the flexible members along two parallel sides and a third side of each of the intercepting areas to define a plurality of elongated side-by-side four-sided pockets co-extensive, respectively, with the four-sided smaller areas, with common sides of said side-by-side pockets coinciding with a common seam of stitching forming one of said parallel sides of each of the adjacent side-by-side areas, the three layers at each said smaller area, comprising the heat-reflecting and heat-insulating layers and one of the flexible members, being permanently secured to each other along the fourth side of the periphery of the smaller heat-intercepting area, each of said elongated pockets having an opening to the outside of said shield along said fourth side of said periphery, and manually separable means for releasably securing said three layers as a unit to the other of the flexible members to form a separate closure for each of said pockets along said fourth side of a respective smaller heat-intercepting area, each said packet being of identical size and essentially filling a respective pocket whereby the sides of that pocket closely confine therein the respective packet of said heat-dissipating material against movement relative to the four sides of the pocket, said heat reflecting and heat insulating layers each being unattached to one another and unattached to either of said flexible members throughout each said smaller area within its four sides.

5. A shield according to claim 4 wherein there are two areas of plural elongated side-by-side pockets.

6. A heat-intercepting shield according to claim 5 wherein said shield is a generally rectangular blanket with said pockets each extending in a common blanket having fastening means on opposite faces thereof to permit the fastening means on one or more such blankets to be secured together with the blankets flat or wrapped around said object with each said heat-intercepting area facing toward or away from said object.

7. A blanket according to claim 5 wherein said fastening means comprises fastening strip means along one edge on one face of the blanket separably and adjustably attachable to relatively transversely extending plural fastening strip means on the other face of the blanket.

8. A blanket according to claim 5 wherein the pocket closures for each of the plural side-by-side smaller areas area along a straight line for each of the respective areas of plural side-by-side pockets.

9. A blanket according to claim 5 wherein the pocket closures for the two areas of plural side-by-side smaller areas are arranged with the pocket openings of one area facing the pocket openings of the other area and the pocket closures for the respective areas are along two closely spaced parallel lines.

10. A blanket structure comprising two or more blankets according to claim 9 interconnected by said fastening means.

11. A shield according to claim 4 wherein there are two areas of plural elongated pockets, said shield being capable of being laid flat with the pocket areas coplanar, the pocket closures of the two areas when in said coplanar position being collinear along one side of the shield to permit the shield to be easily loaded with said packets from said one side.

12. A shield according to claim 11 in the form of a garment having at least one flexible casing with three such pockets side-by-side and having means for suspending each said casing from the shoulders of a standing person and for holding each said casing against the person's waist with said elongated pockets oriented horizontally.

13. A shield according to claim 11 in the form of a garment having two such flexible casings each with three such pockets side-by-side and forming front and rear panels of the garment and having means for suspending said panels from the shoulders of a standing person and for holding said panels against the person's waist with said elongated pockets oriented horizontally.

14. A garment according to claim 13 wherein said shield casings for both the front and rear panels have casing portions extending beyond both ends of each of the central of the three pockets therein for at least partially wrapping around said person, and means for connecting each said extension of the rear panel casing to respective casing extensions of the front panel of the shield to aid in holding the ends of at least the central pocket flat against the person's body, said connecting means and said extensions cooperating with the ends of said pockets to distribute the securing forces transversely across the ends of at least the central pockets to hold such pockets and the entire face of one side of the packets therein in good heat transfer relationship with the surface of the person's body.

15. A garment according to claim 13 including means for separably said panels to each other at the shoulders and at the waist to enable replacement of one panel during use on a person without removing the other panel.

16. A garment according to claim 13 wherein said shield casings for both the front and rear panels have casing portions extending beyond both ends of each of the central of the three pockets therein for at least partially wrapping around said person, and means for connecting each said extension of the rear panel casing to respective casing extensions of the front panel of the shield to aid in holding the ends of at least the central pocket flat against the person's body, said rear panel casing extensions each being of essentially the same width as the central pocket and extending around the person to overlap the front panel casing extensions at the ends of the front central pocket, said connecting means comprising fastening means in the form of vertically spaced pairs of cooperating separable fastening strips secured to the rear panel casing extensions and across the front panel casing at each side of the garment.

* * * * *